US007936090B2

(12) United States Patent
Chien et al.

(10) Patent No.: US 7,936,090 B2
(45) Date of Patent: May 3, 2011

(54) DRIVING CIRCUIT AND METHOD FOR DRIVING CURRENT-DRIVEN DEVICES

(75) Inventors: Feng-Wei Chien, Hsinchu (TW); Tsung-Hau Chang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 53 days.

(21) Appl. No.: 12/554,855

(22) Filed: Sep. 4, 2009

(65) Prior Publication Data

US 2010/0156177 A1 Jun. 24, 2010

(30) Foreign Application Priority Data

Dec. 23, 2008 (TW) ..... 97150324 A

(51) Int. Cl.
*H02J 1/00* (2006.01)

(52) U.S. Cl. ..... 307/31; 307/39; 307/131

(58) Field of Classification Search ..... 307/31, 307/38, 39, 125, 130, 131
See application file for complete search history.

(56) References Cited

U.S. PATENT DOCUMENTS 5,900,680 A * 5/1999 Prey ..... 307/31
2010/0283322 A1* 11/2010 Wibben ..... 307/31
2010/0295472 A1* 11/2010 Wibben et al. ..... 307/31

* cited by examiner

*Primary Examiner* — Fritz M Fleming
(74) *Attorney, Agent, or Firm* — Rabin & Berdo, P.C.

(57) ABSTRACT

At the driving initiation, whether the output channels are enabled or disabled is determined by judging whether the voltages of the output channels are changed by a charging or discharging operation. The current output sources corresponding to the disabled output channels are turned off for power-saving. In the voltage conversion, the status of the disabled output channels is ignored, for accurately control of the voltage conversion.

18 Claims, 5 Drawing Sheets

DRIVING CIRCUIT AND METHOD FOR DRIVING CURRENT-DRIVEN DEVICES

This application claims the benefit of Taiwan application Serial No. 97150324, filed Dec. 23, 2008, the subject matter of which is incorporated herein by reference.

BACKGROUND OF THE APPLICATION

1. Field of the Application

The application relates in general to a LED (Light Emitting Diode) driver of current-driven devices, and more particularly, to a driving circuit of current-driven devices, which can determine whether the output channel is available for power-saving and control the output voltage. accurately 2. Description of the Related Art A light emitting diode (LED) has advantages of low power consumption, long lifetime, small volume and short response time. Therefore, the LED increasingly is adopted on the conventional lamp bulb. Besides, the LED can also be applied in domestic electric appliances and used as a backlight source for a notebook computer. Compared with a notebook computer using cold-cathode-fluorescence lamps (CCFLs), the notebook compute using LEDs can save more power and elongate lifetime of the battery.

This kind of electronic device (such as a notebook computer) includes an LED driving circuit for driving the LEDs. Normally, the electronic device is configured with a number of LED channels, but sometimes, a part of which are not used and set at a floating state. If there is no good mechanism for detecting which LED channels are at floating state and accordingly controlling the floating-state LED channels, the floating-state LED channels easily cause unnecessary power consumptions, influence conversion efficiency of the whole circuit and increase power consumption, or even cause an error determination and operation of the DC-DC converter.

For this reason, an example of the invention provides a driving circuit which can detect whether the LED channels are enabled or disabled at the initiation. Accordingly, the LED driver can turn off the disabled LED channels and ignore the feedback status thereof in order to save power, increase conversion efficiency of the whole circuit, and reduce the error determination to make the DC-DC converter in normal operation.

SUMMARY

The application is directed to a driving circuit and method for driving a number of current-driven devices. The driving circuit and method can determine whether the output channels are enabled or disabled, and turns off the according output current sources to achieve a power-saving function.

The application is directed to a driving circuit and method for driving a number of current-driven devices. The driving circuit and method can determine whether the output channels are enabled or disabled, and ignore the status of the disabled output channels to control the output voltage accurately.

According to an example of the present application, a driving circuit for driving a number of current-driven devices is provided. The driving circuit comprises a voltage converter and a controller. The voltage converter is for converting an input voltage into an output voltage for driving the current-driven devices. The controller is coupled to the voltage converter and the current-driven devices. The controller includes a voltage-converter controller, a channel-enablement detector and a number of output channel terminals. The controller is for controlling the voltage converter. The channel-enablement detector is coupled to the controller. The output channel terminals are coupled to the channel-enablement detector, wherein the output channel terminals are further coupled to a reference voltage or the current driven devices. The detecting current sources are coupled to the output channel terminals. At an initiation of the driving circuit, the channel-enablement detector detects whether a plurality of voltages at the output channel terminals are changed by the detecting current sources and accordingly determines whether the output channel terminals are coupled to the current-driven devices.

According to another example of the present application, a driving method for driving a number of current-driven devices is provided. The driving method comprises converting an input voltage into an output voltage for driving the current-driven devices; at an initiation, detecting whether a plurality of voltages of a plurality of output channel terminals are changed by a charging or discharging operation and accordingly determining whether the output channel terminals are coupled to the current-driven devices or a reference voltage; ignoring status of the output channel terminals coupled to the reference voltage and turning off a plurality of current output sources of the output channel terminals coupled to the reference voltage; and selecting a minimum value from the voltages of the output channel terminals coupled to the current-driven devices and controlling the voltage-converting step according to the minimum value.

The application will become apparent from the following detailed description of the non-limiting embodiments. The following description is made with reference to the accompanying drawings.

DETAILED DESCRIPTION OF EMBODIMENTS OF THE INVENTION

In the embodiments of the invention, it is determined whether the output channels are enabled or disabled. The current output sources of the disabled output channels will be turned off for power-saving. Besides, in voltage conversion, the status of the disabled output channels is ignored to accurately control the voltage conversion.

First Embodiment of the Invention

Figure 1:
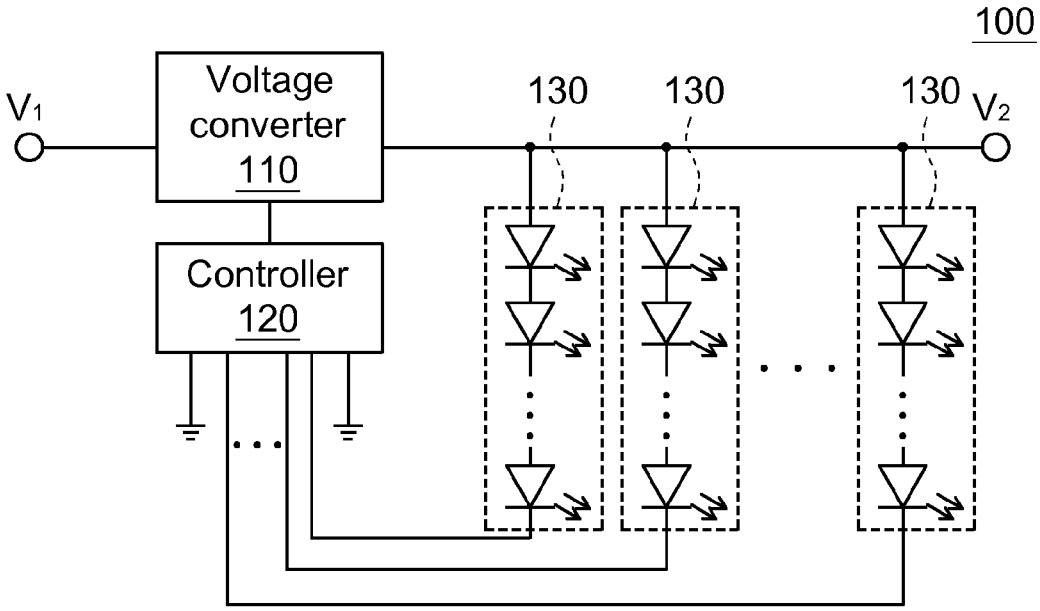
FIG. 1 is a block diagram of an LED driving circuit according to a first embodiment of the invention.

FIG. 1 is a block diagram of an LED driving circuit according to a first embodiment of the invention. As shown in FIG.

1, the LED driving circuit 100 of the first embodiment at least includes a voltage converter 110 and a controller 120. The LED driving circuit 100 is for driving a number of LED groups 130.

The voltage converter 110 converts an input voltage V1 into an output voltage V2. The voltage conversion performed by the voltage converter 110 can be voltage boosting, voltage bucking or voltage boost-bucking. One of features of the voltage converter 110 lies in that the output voltage V2 can supply currents to drive loads, such as the LED groups 130, and the output voltage V2 can be controlled accurately. In the LED driving circuit 10, the output terminal of the voltage converter 110 is coupled to the LED groups 130 for supplying the output voltage V2 to drive the LED groups 130.

The controller 120 has a number of output channel terminals. All, some or none of the output channel terminals may be coupled to the LED groups 130, and all, some or none of the output channel terminals may be coupled to a ground voltage. The controller 120 can include a constant current source for driving the LED groups 130. The controller 120 transmits (i.e. feeds back) the status of the LED groups 130 to the voltage converter 110 and accordingly controls the voltage converter 110, such that the voltage converter 110 can generate the output voltage V2. The feedback mechanism enables the LED driving circuit 100 to drive the LED groups 130 stably. Further, the controller 120 and the voltage converter 110 can be integrated into a chip. The control mode of the controller 120 can be voltage mode/current mode pulse width modulation (PWM), pulse frequency modulation (PFM), or a combination thereof, or other control modes suitable for controlling the voltage converter 110.

At initiation of the LED driving circuit 100, the controller 120 can determine which output channel terminals are coupled to the LED groups 130 (i.e. which output channels are enabled) and which output channel terminals are not coupled to the LED groups 130 (i.e. which output channels are disabled). Then, the controller 120 can give a corresponding response to the disabled output channels. When the LED driving circuit 100 is already set but has not started to operate, the controller 120 can detect the disabled output channel(s), turn off the disabled output channel(s) and ignore the status of the feedback terminal(s) thereof for power-saving.

Figure 2A:
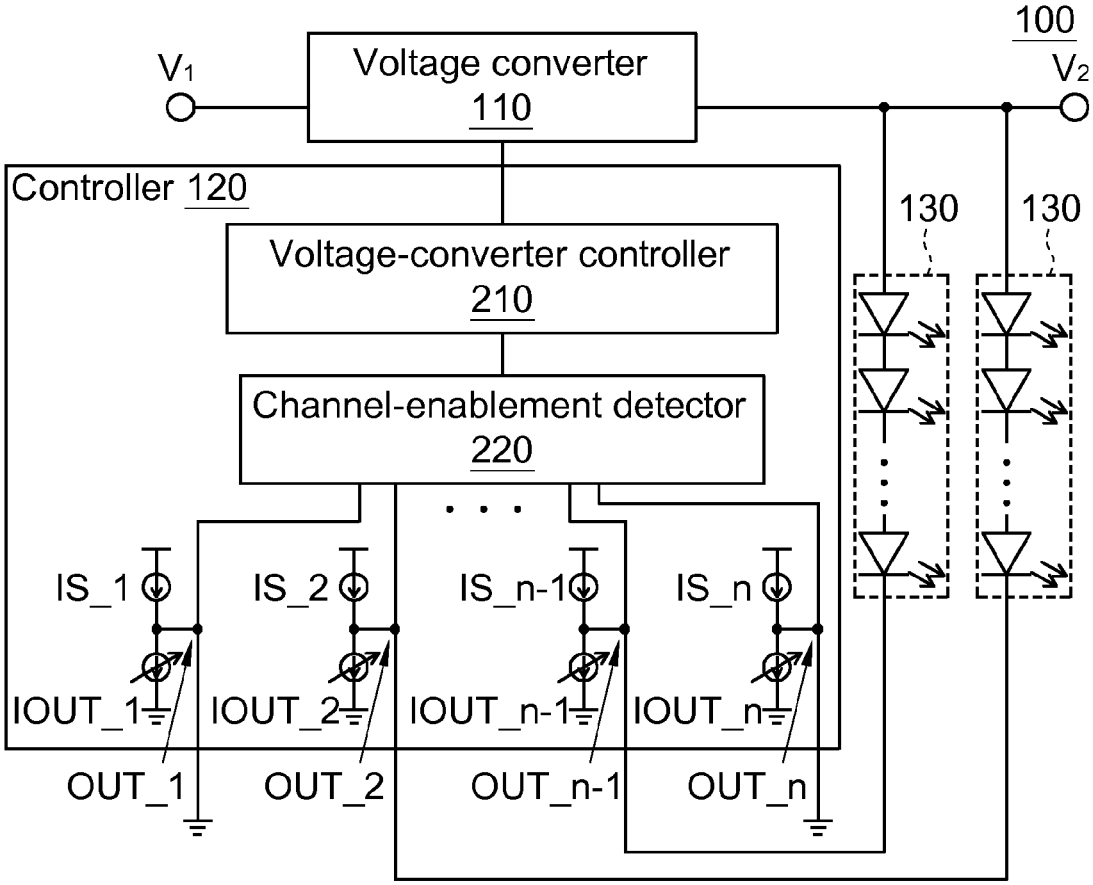
FIG. 2A is a detailed block diagram of the controller according to the first embodiment of the invention.

FIG. 2A shows a detailed block diagram of the controller according to the first embodiment of the invention. As shown in FIG. 2A, the controller 120 includes a voltage-converter controller 210, a channel-enablement detector 220, detecting current sources IS_1~IS_n, and current output sources IOUT_1~IOUT_n. The detecting current sources IS_1~IS_n are current sources for instance.

When the LED driving circuit 100 has not started to operate, the output voltage V2 of the voltage converter 110 has not been lifted to a high voltage and the current output sources IOUT_1~IOUT_n are temporarily in non-conductive state. The output channel terminals OUT_1~OUT_n are respectively coupled to the detecting current sources IS_1~IS_n. It can be determined which output channel is enabled from the voltages of the output channel terminals OUT_1~OUT_n. One LED group 130 and a corresponding current output source IOUT form an output channel.

Figure 3A:
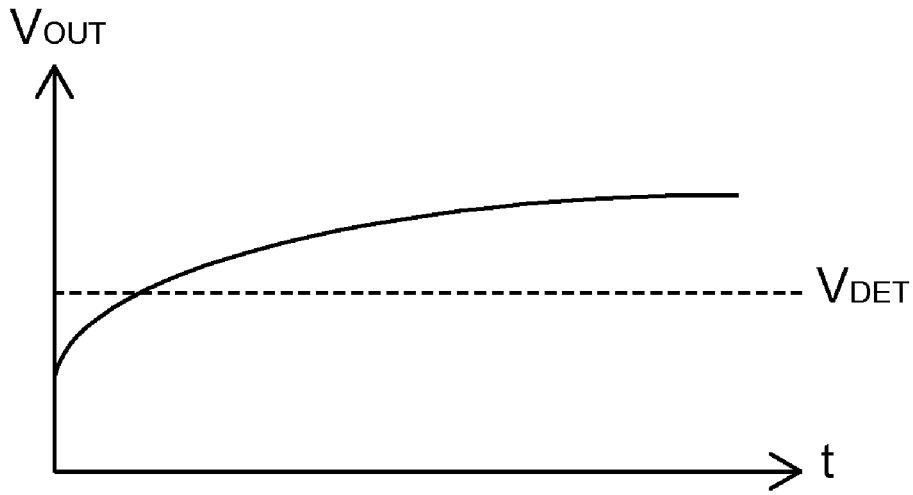
FIG. 3A is a waveform diagram at the enabled output channel according to the first embodiment of the invention.
Figure 3B:
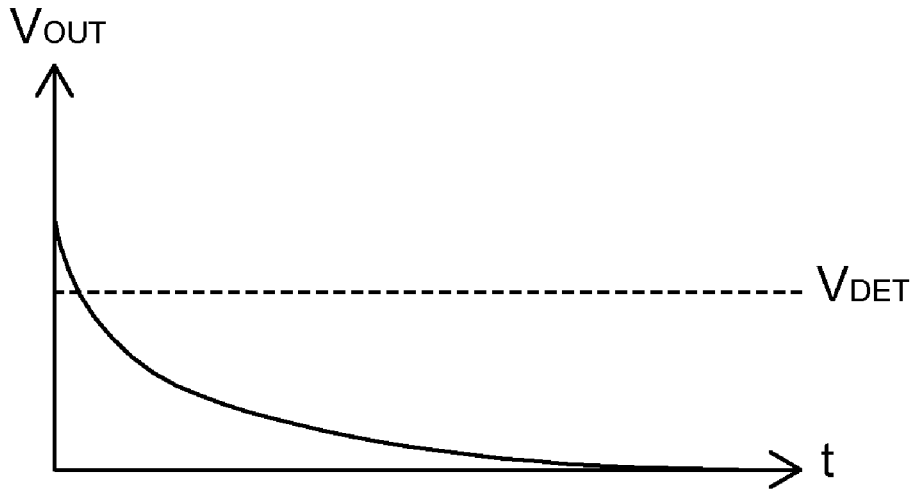
FIG. 3B is a waveform diagram at the disabled output channel according to the first embodiment of the invention.

Determining if the output channel is enabled or disabled can be understood by referring to FIGS. 3A and 3B. FIGS. 3A and 3B respectively show waveform diagrams of the voltages at the output channel terminals according to the first embodiment of the invention. FIG. 3A shows the waveform diagram of the enabled output channel terminals while FIG. 3B shows the waveform diagram of the disabled output channel terminals. The voltages at the output channel terminals can also be referred as voltages of the output channels.

The voltages of the output channels are unknown because, at the beginning, all output channels are non-conductive. At initiation, the parasitic capacitor of the output channel terminal OUT is charged by the detecting current source IS. If the output channel is enabled (i.e. coupled to the LED groups), under the charging of the detecting current source IS, the output channel terminal OUT is charged to have a voltage higher than a detection voltage $V_{DET}$, as shown in FIG. 3A. Therefore, if the voltage at the output channel terminal OUT is higher than the detection voltage $V_{DET}$ after a period of time, the channel-enablement detector 220 can determine that the corresponding output channel is at an enabled state. The setting of the detection voltage $V_{DET}$ is related to the charging ability of the detecting current source IS, and thus the value of the detection voltage $V_{DET}$ can be set according to the charging ability of the detecting current source IS in practical application.

Conversely, when the output channel is unused (disabled), owing that the output channel is coupled to a low ground voltage (GND), even under charging of the detecting current source IS, the corresponding output channel terminal will still be pulled down to the low voltage and will not be charged to have a voltage higher than the detection voltage $V_{DET}$, as shown in FIG. 3B. After a period of time, if the channel-enablement detector 220 detects and determines that the output channel terminal has a voltage lower than the detection voltage $V_{DET}$, the corresponding output channel is determined to be disabled.

Figure 2B:
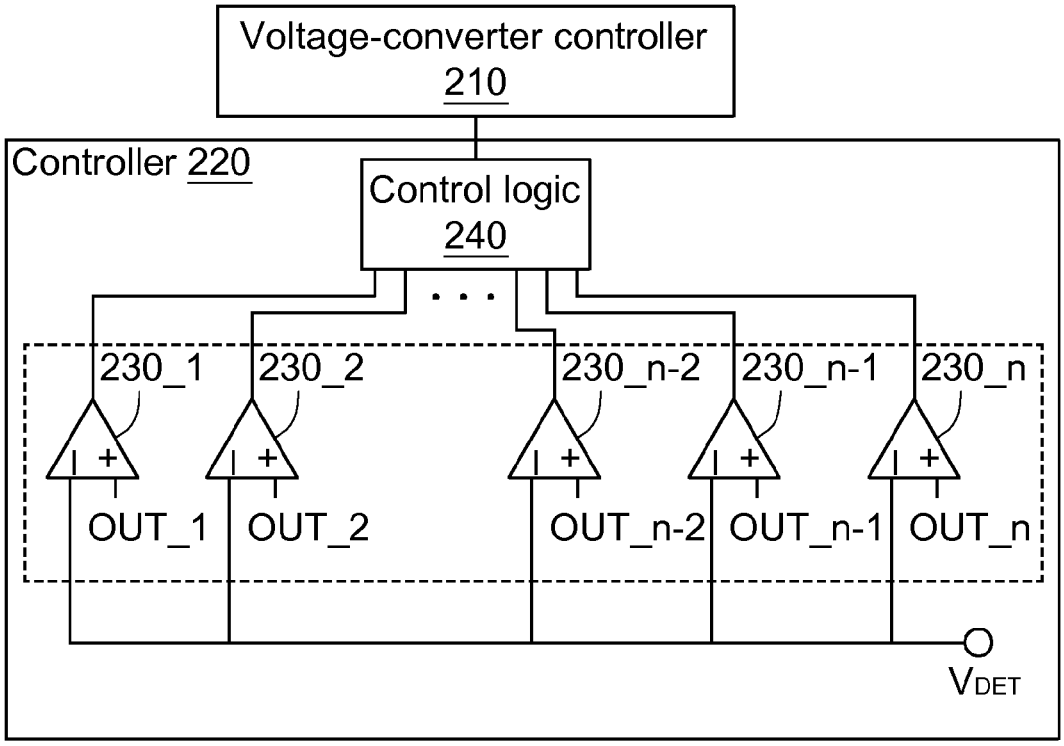
FIGS. 2B and 2C are two examples of the channel-enablement detector according to the first embodiment of the invention.
Figure 2C:
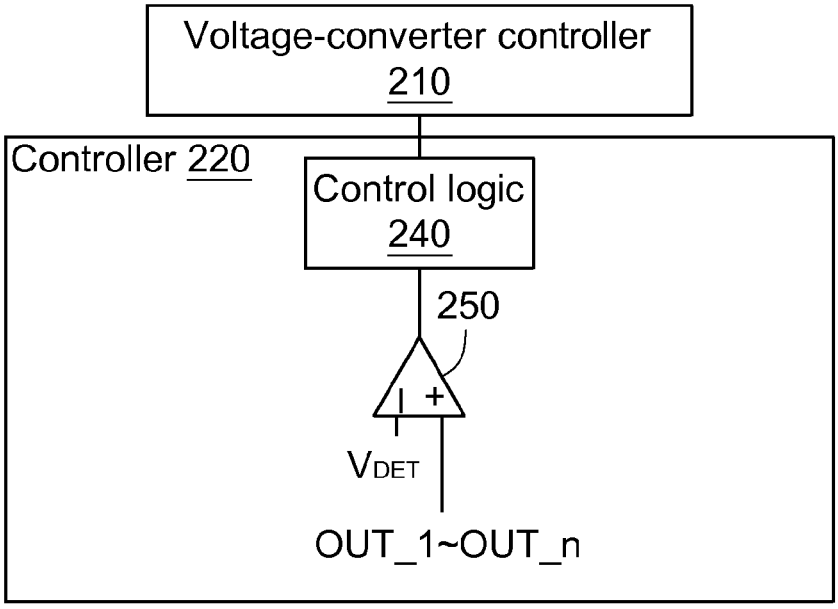

Referring to FIGS. 2B and 2C, two examples of the channel-enablement detector 220 according to the first embodiment of the invention are shown. As shown in FIG. 2B, the channel-enablement detector 220 at least includes a number of comparators 230_1~230_*n* and a control logic 240. The comparators 230_1~230_*n* are used for comparing the voltages of the output channel terminals with the detection voltage $V_{DET}$. The comparison result of the comparators is transmitted to the control logic 240. Besides, as shown in FIG. 2C, by time division multiple access concept, the channel-enablement detector 220 can detect whether the channel is disabled by using one comparator 250.

If the comparison result shows some of the output channels are disabled, the control logic 240 ignores the status of the disabled output channels and turns off the corresponding current output sources IOUT of the output channels for power-saving.

Besides, the control logic 240 selects a minimum value from the voltages of the enabled output channel terminals (i.e. a smallest voltage value higher than the detection voltage $V_{DET}$) and transmits the minimum value to the voltage-converter controller 210. The voltage-converter controller 210 controls the voltage-converting operation of the voltage converter 110 such that the voltage converter 110 can generate the output voltage V2.

After the initial detection ends, the detecting current sources (current sources) IS_1~IS_n are transformed into a power-off state and the current output sources IOUT_1~IOUT_n corresponding to the enabled output channels are transformed from a power-off state into a power-on state. The output voltage V2 of the voltage converter 110 reaches a stable voltage such that the LED groups 130 are completely turned on, and at the time, the controller 120 reaches a stable state.

Second Embodiment of the Invention

Figure 4:
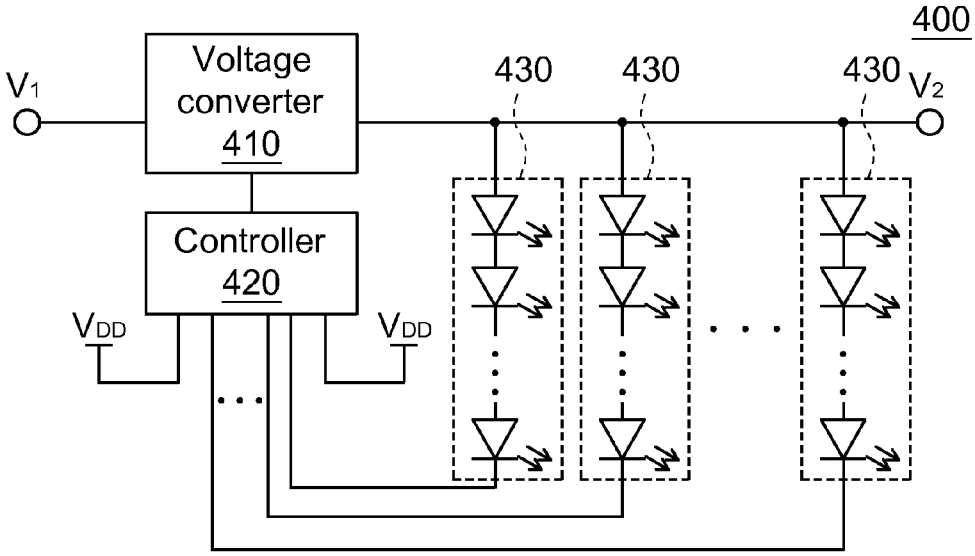
FIG. 4 is a block diagram of an LED driving circuit according to a second embodiment of the invention.

FIG. 4 is a block diagram of an LED driving circuit according to a second embodiment of the invention. As shown in FIG. 4, the LED driving circuit 400 of the second embodiment at least includes a voltage converter 410 and a controller 420. The LED driving circuit 400 is for driving a number of LED groups 430. The operation of the voltage converter 410 is similar to that of the voltage converter 110 and thus any detail is not necessarily given here.

The controller 420 has a number of output channel terminals. All, some or none of the output channel terminals may be coupled to the LED groups 430, and all, some or none of the output channel terminals may be coupled to a high voltage VDD. Basically, the controllers 420 and 120 have similar operation principles. The following description is provided to illustrate their difference.

Similarly, at the initiation of the LED driving circuit 400, the controller 420 can determine which output channel terminals are coupled to the LED groups 430 (i.e. which output channels are enabled) and which output channel terminals are coupled the high voltage VDD (i.e. which output channels are disabled). Then, the controller 420 can give a corresponding response to the disabled output channels. When the LED driving circuit 400 is set but has not started to operate, the controller 420 can detect the disabled output channel(s), turn off the disabled output channel(s) and ignore the status of the feedback terminal thereof for power-saving.

Figure 5:
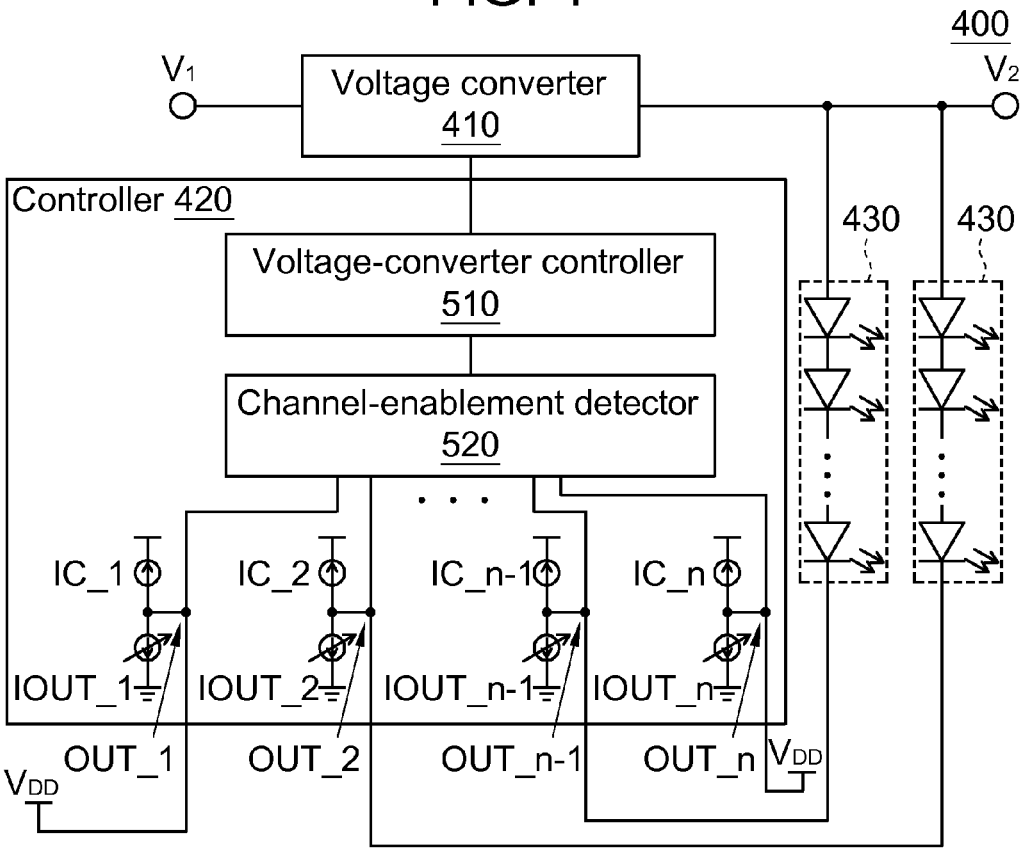
FIG. 5 is a detailed block diagram of the controller according to the second embodiment of the invention.

FIG. 5 shows a detailed block diagram of the controller according to the second embodiment of the invention. As shown in FIG. 5, the controller 420 includes a voltage-converter controller 510, a channel-enablement detector 520, detecting current sources IC_1~IC_n, and current output sources IOUT_1~IOUT_n. The detecting current sources IC_1~IC_n are current sinks for instance.

When the LED driving circuit 400 has not started to operate, the output voltage V2 of the voltage converter 410 has not been lifted to a high voltage and the current output sources IOUT_1~IOUT_n are temporarily set in a non-conductive state. The output channel terminals OUT_1~OUT_n are respectively coupled to the detecting current sources IC_1~IC_n. It can be determined which output channel is enabled from the voltages of the output channel terminals OUT_1~OUT_n.

Figure 6A:
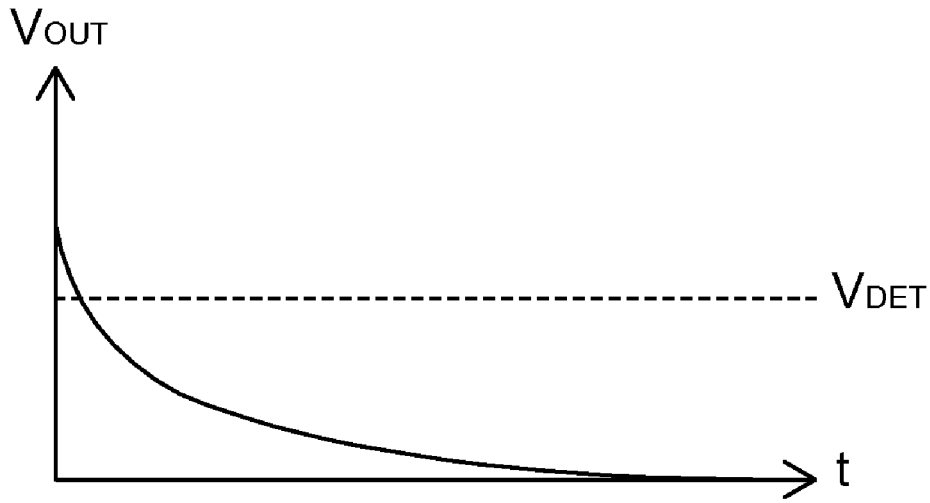
FIG. 6A is a waveform diagram at the enabled output channel according to the second embodiment of the invention.
Figure 6B:
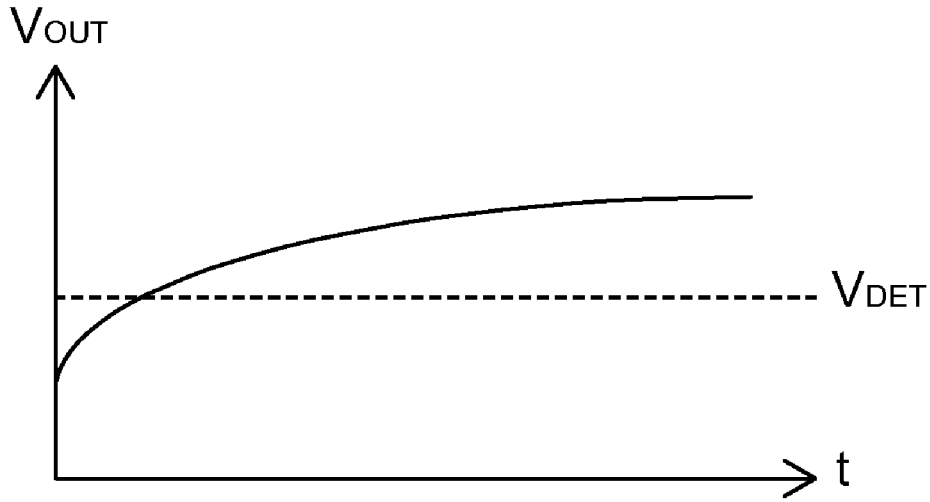
FIG. 6B is a waveform diagram at the disabled output channel according to the second embodiment of the invention.

Determining if the output channel is enabled or disabled can be understood by referring to FIGS. 6A and 6B. FIGS. 6A and 6B respectively show waveform diagrams of the voltages at the output channel terminals according to the second embodiment of the invention. FIG. 6A shows the waveform diagram of the enabled output channel terminals while FIG. 6B shows the waveform diagram of the disabled output channel terminals. The voltages at the output channel terminals can also be called voltages of the output channels.

The voltages of the output channels are unknown because at the beginning, the output channels are non-conductive. At initiation, the parasitic capacitor of the output channel terminal OUT is discharged by the detecting current source IC. If the output channel is enabled (i.e. coupled to the LED groups), under the discharging of the detecting current source IC, the output channel terminal OUT is discharged to have a voltage lower than a detection voltage $V_{DET}$, as shown in FIG. 6A. Therefore, if the voltage at the output channel terminal OUT is lower than the detection voltage $V_{DET}$ after a period of time, the channel-enablement detector 520 can determine that the corresponding output channel is at an enabled state.

Conversely, when the output channel is unused (disabled), owing that the unused output channel is coupled to the high VDD, even under discharging of the detecting current source IC, the corresponding output channel terminal will still be pulled up to the high voltage and will not be discharged to have a voltage lower than the detection voltage $V_{DET}$, as shown in FIG. 6B. After a period of time, when the channel-enablement detector 520 detects and determines the output channel terminal has a voltage higher than the detection voltage $V_{DET}$, the corresponding output channel is determined to be disabled. Basically, the structure of the channel-enablement detector 520 is similar to that of the channel-enablement detector 220. The setting of the detection voltage $V_{DET}$ is related to the discharging ability of the detecting current source IC, and thus the value of the detection voltage $V_{DET}$ can be set according to the discharging ability of the detecting current source IC in practical application.

If some of the output channels are detected to be disabled, the controller 420 ignores the status of the disabled output channels, turns off the current output sources of the disabled output channels for power-saving.

After the initial detection ends, the detecting current sources (current sinks) IC_1~IC_n are into a power-off state and the current output sources IOUT_1~IOUT_n corresponding to the enabled output channels are into a power-on state. The output voltage V2 of the voltage converter 410 reaches a stable voltage such that the LED groups 430 are completely turned on, and at the time, the controller 420 reaches a stable state.

Additionally, embodiments of the invention are not limited to being applied to the LED driving circuit. For example, other types of current-driven devices can also take place of the LED groups and the current-driven devices can be accurately driven by using the above architecture.

According to the above-mentioned embodiments of the invention, the disabled output channel is coupled to the reference voltage (GND or VDD) while the enabled output channel is coupled to the LED groups. Therefore, under influence of the detecting current sources in the controller, after the circuit is initiated for a period of time, if the voltage of an output channel terminal is changed, it implies the corresponding output channel is enabled; conversely, if the voltage of an output channel terminal is not changed, it implies the corresponding output channel is disabled. By determining whether the output channel is enabled or disabled, the power-saving function can be achieved and the voltage conversion of the voltage converter can be accurately controlled.

It will be appreciated by those skilled in the art that changes could be made to the disclosed embodiments described above without departing from the broad inventive concept thereof. It is understood, therefore, that the disclosed embodiments are not limited to the particular examples disclosed, but is intended to cover modifications within the spirit and scope of the disclosed embodiments as defined by the claims that follow.

What is claimed is:

1. A driving circuit for driving a plurality of current-driven devices, the driving circuit comprising:

a voltage converter, for converting an input voltage into an output voltage for driving the current-driven devices; and a controller, coupled to the voltage converter and the current-driven devices, the controller comprising:

a voltage-converter controller, for controlling the voltage converter;

a channel-enablement detector, coupled to the voltage-converter controller;

a plurality of output channel terminals, coupled to the channel-enablement detector, wherein the output channel terminals are further coupled to a reference voltage or the current-driven devices; and a plurality of detecting current sources, coupled to the output channel terminals;

wherein at an initiation of the driving circuit, the channel-enablement detector detects whether a plurality of voltages at the output channel terminals are changed by the detecting current sources and accordingly determines whether the output channel terminals are coupled to the current-driven devices.

2. The driving circuit according to claim 1, further comprising a plurality of current output sources coupled to the output channel terminals.

3. The driving circuit according to claim 2, wherein when the reference voltage is a ground voltage, the detecting current sources comprise a plurality of current sources.

4. The driving circuit according to claim 3, wherein at the initiation of the driving circuit, under charging of the current sources, if a voltage of one of the output channel terminals is higher than a detection voltage, the one of the output channel terminals is determined to be coupled to the current-driven devices.

5. The driving circuit according to claim 4, wherein at the initiation of the driving circuit, under charging of the current sources, if a voltage of one of the output channel terminals is lower than the detection voltage, the one of the output channel terminals is determined to be coupled to the reference voltage.

6. The driving circuit according to claim 5, wherein the channel-enablement detector ignores status of the output channel terminals coupled to the reference voltage and turns off the current output sources corresponding to the output channel terminals coupled to the reference voltage.

7. The driving circuit according to claim 6, wherein the channel-enablement detector selects a minimum value from the voltages of the output channel terminals coupled to the current-driven devices and transmits the minimum value to the voltage-converter controller, and the voltage-converter controller controls the voltage converter according to the minimum value.

8. The driving circuit according to claim 7, wherein after an initial detection ends, the detecting current sources are powered off, and the current output sources corresponding to the output channel terminals coupled to the current-driven devices are powered on.

9. The driving circuit according to claim 2, wherein when the reference voltage is a high reference voltage, the detecting current sources comprise a plurality of current sinks.

10. The driving circuit according to claim 9, wherein at the initiation of the driving circuit, under discharging of the current sinks, if a voltage of one of the output channel terminals is lower than a detection voltage, the one of the output channel terminals is determined to be coupled to the current-driven devices.

11. The driving circuit according to claim 10, wherein at the initiation of the driving circuit, under discharging of the current sinks, if a voltage of one of the output channel terminals is higher than the detection voltage, the one of the output channel terminals is determined to be coupled to the reference voltage.

12. A driving method for driving a plurality of current-driven devices, the driving method comprising:

converting an input voltage into an output voltage for driving the current-driven devices;

at an initiation, detecting whether a plurality of voltages of a plurality of output channel terminals are changed by a charging or discharging operation and accordingly determining whether the output channel terminals are coupled to the current-driven devices or a reference voltage;

ignoring status of the output channel terminals coupled to the reference voltage and turning off a plurality of current output sources of the output channel terminals coupled to the reference voltage; and selecting a minimum value from the voltages of the output channel terminals coupled to the current-driven devices and controlling the voltage-converting step according to the minimum value.

13. The driving method according to claim 12, wherein when the reference voltage is a ground voltage, the step of detecting whether the voltages of the output channel terminals are changed by the charging or discharging operation further comprises:

charging by a plurality of current sources.

14. The driving method according to claim 13, wherein the step of determining whether the output channel terminals are coupled to the current-driven devices or the reference voltage comprises:

at the initiation, under charging of the current sources, if a voltage of one of the output channel terminals is higher than a detection voltage, determining the one of the output channel terminal to be coupled to the current-driven devices.

15. The driving method according to claim 14, wherein the step of determining whether the output channel terminals are coupled to the current-driven devices or the reference voltage comprises:

at the initiation, under charging of the current sources, if a voltage of one of the output channel terminals is lower than the detection voltage, determining the one of the output channel terminal to be coupled to the reference voltage.

16. The driving method according to claim 12, wherein when the reference voltage is a high reference voltage, the step of detecting whether the voltages of the output channel terminals are changed by the charging or discharging operation further comprises:

discharging by a plurality of current sinks.

17. The driving method according to claim 12, wherein the step of determining whether the output channel terminals are coupled to the current-driven devices or the reference voltage comprises:

at the initiation, under discharging of the current sinks, if a voltage of one of the output channel terminals is lower than a detection voltage, determining the one of the output channel terminal to be coupled to the current-driven devices.

18. The driving method according to claim 17, wherein the step of determining whether the output channel terminals are coupled to the current-driven devices or the reference voltage comprises:

at the initiation, under discharging of the current sinks, if a voltage of one of the output channel terminals is higher than a detection voltage, determining the one of the output channel terminal to be coupled to the reference voltage.

* * * * *